US008413287B2

(12) United States Patent
Arledge

(10) Patent No.: US 8,413,287 B2
(45) Date of Patent: Apr. 9, 2013

(54) GOLF EQUIPMENT CLEANING METHOD AND DEVICE

(76) Inventor: Craig Arledge, Lubbock, TX (US)

( * ) Notice: Subject to any disclaimer, the term of this patent is extended or adjusted under 35 U.S.C. 154(b) by 163 days.

(21) Appl. No.: 12/912,973

(22) Filed: Oct. 27, 2010

(65) Prior Publication Data

US 2011/0099736 A1 May 5, 2011

Related U.S. Application Data

(60) Provisional application No. 61/256,598, filed on Oct. 30, 2009.

(51) Int. Cl.
*A46B 15/00* (2006.01)
*A63B 57/00* (2006.01)
*A46B 13/00* (2006.01)

(52) U.S. Cl.
USPC ..... 15/160; 15/161; 15/246; 301/37.41

(58) Field of Classification Search ..... 15/160, 15/161, 246, 88.4, 49.1, 41.1, 42, 21.1; 301/37.101, 301/37.102, 37.26, 37.42; 280/DIG. 6, 164.2
See application file for complete search history.

(56) References Cited

U.S. PATENT DOCUMENTS

| | | | | |
|---|---|---|---|---|
| 3,747,150 | A * | 7/1973 | Kozub | 15/105 |
| 5,075,917 | A | 12/1991 | Wheat | |
| 5,077,858 | A * | 1/1992 | Lewis, Jr. | 15/161 |
| 5,316,376 | A * | 5/1994 | Defreitas | 301/37.26 |
| D370,348 | S | 6/1996 | McElheney | |
| 6,302,269 | B1 * | 10/2001 | Risch | 206/362.3 |
| 6,363,567 | B1 | 4/2002 | Woodward | |
| 6,968,588 | B2 | 11/2005 | Nemcek | |
| 2009/0152857 | A1 * | 6/2009 | Easley | 280/855 |

FOREIGN PATENT DOCUMENTS

AU 681284 B2 * 3/1994

OTHER PUBLICATIONS

Flat definition, the free online dictionary, 2009.*
Dome definition, the free online dictionary, 2009.*

* cited by examiner

*Primary Examiner* — Monica Carter
*Assistant Examiner* — Andrew A Horton
(74) *Attorney, Agent, or Firm* — Susanne M Moore

(57) ABSTRACT

A method and device for cleaning golf equipment while on the golf course, the device being mounted to, and rotating in conjunction with, a golf cart wheel.

12 Claims, 3 Drawing Sheets

GOLF EQUIPMENT CLEANING METHOD AND DEVICE

CROSS REFERENCE TO RELATED APPLICATIONS

This application claims the benefit of provisional patent application 61/256,598 filed on Oct. 30, 2009 by the present inventor and the application is hereby incorporated by reference in its entirety.

STATEMENT REGARDING FEDERALLY SPONSORED RESEARCH OR DEVELOPMENT

Not Applicable

NAMES OF PARTIES TO JOINT RESEARCH AGREEMENT

Not Applicable

REFERENCE TO SEQUENCE LISTING

Not Applicable

DESCRIPTION OF ATTACHED APPENDIX

Not Applicable

BACKGROUND OF THE INVENTION

1. Field of the Invention

This invention relates generally to golf equipment and more particularly, to a method and apparatus for cleaning one's golf equipment while on the golf course.

2. Description of Related Art

Despite the ever increasing availability of high tech golfing accessories, a common problem still remains. The process of playing golf causes an accumulation of grass, dirt, mud and debris on one's golf shoes, golf balls and golf clubs. Many golfers wear golf shoes which have cleats or spikes on the sole and heel, compounding the accumulation. To solve this problem, many cleaning devices and brushes have been invented, some of which tether to a golf bag, some of which mount to vehicles, and some are designed to be carried on the golfer's person.

It is commonly accepted that clean golf clubs hit truer. Clean golf balls are known to fly straighter and clean golf shoes are known to provide more stability. As a result, the industry has been flooded with devices to clean golf equipment.

U.S. Pat. No. 5,230,117 describes a brush handle having soft bristles on one side and stiff bronze bristles on another. The handle is tethered to a golf bag. U.S. Pat. No. 6,430,770 describes a device that includes a plastic bottle with brushes inside for cleaning golf club heads. U.S. Pat. Nos. 6,898,817 and 6,363,567 both describe golf equipment cleaning devices that mount to automobiles.

Golfers, however, already carry a great deal of gear and would prefer not to carry additional items such as a cleaning brush. Additional hand carried items are easy to misplace and burdensome to carry. It is neither cost effective nor practical to mount golf cleaning equipment to one's personal automobile. Golf equipment is needed at the golf course. It is not something that should necessarily be mounted to a person's automobile, considering an automobile is used for many other purposes than transportation to and from the golf course.

Furthermore the user needs to be able to clean golf equipment while actually on the golf course, not out in the golf course parking lot. It is important to be able to clean one's golf clubs, shoes and balls while actually progressing from hole to hole on the golf course.

In the past, country clubs understood this inconvenience and responded by installing free standing blocks on the golf course grounds with mounted brushes for cleaning purposes. In recent years, fewer clubs have wished to incur the expense and have eliminated this amenity. Inventors have responded by developing a new wave of carry along inventions for cleaning golf equipment while on the course, yet having to transport a cleaning device poses an inconvenience to the golfer.

Despite the innovations, the golfing industry still lacks a convenient and effective device to clean one's golf equipment.

SUMMARY OF THE INVENTION

In accordance with the present invention, a method and device is disclosed for cleaning one's golf equipment conveniently at the golf course, without having to personally transport the cleaning device.

An objective of the disclosure is a portable method and device for cleaning golf equipment while on the golf course.

An objective of the disclosure is a method and device to clean golf equipment without the device having to be carried on one's person or in a golf bag.

An objective of the disclosure is a method and device for accessibility of golf equipment cleaning without mounting or transportation of a cleaning device in an automobile.

An objective of the disclosure is a method and device to clean golf club heads while walking the golf course.

An objective of the disclosure is a method and device to clean golf shoes in between holes of golf, without leaving the course.

An objective of the disclosure is a method and device to clean golf balls without leaving the course.

An objective of the disclosure is a method and device for ensuring that the golf equipment cleaning device does not get misplaced.

An objective of the disclosure is a method and device for easy accessibility of golf equipment cleaning on the course, while limiting the possibility of injuring or damaging persons or property.

Other objects and advantages of the present invention will become apparent from the following descriptions, taken in connection with the accompanying figures, wherein, by way of illustration and example, an embodiment of the present invention is disclosed.

BRIEF DESCRIPTION OF THE DRAWINGS

The figures constitute a part of this specification and include exemplary embodiments to the invention, which may be embodied in various forms. It is to be understood that in some instances various aspects of the invention may be shown exaggerated or enlarged to facilitate an understanding of the invention. To enable more thorough understanding of the features and advantages of the present invention, reference is now made to the detailed description of the invention along with the accompanying figures in which.

DETAILED DESCRIPTION OF THE PREFERRED EMBODIMENTS

Figure 1:
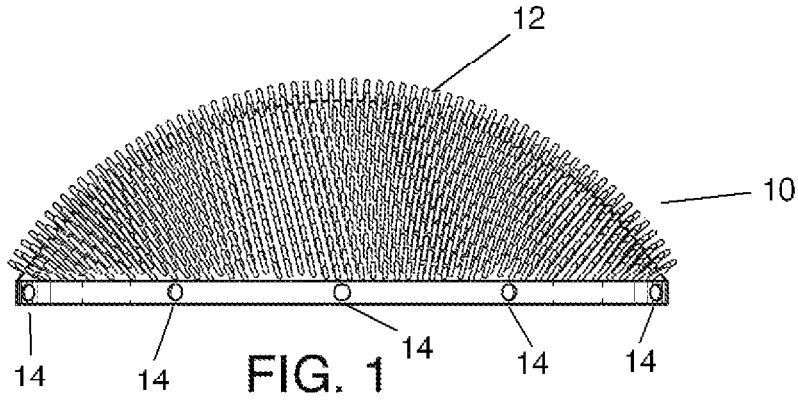
FIG. 1 is a side view of a preferred embodiment of the disclosed invention.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The preferred embodiment of the disclosed invention is a bowl or dome shaped cover having a hollow interior and easily mounting to and covering the exterior side of a wheel on a three wheeled golf cart or a motorized golf cart. The cover has one or more cleaning areas projecting from it, which may include brush bristles, thermoplastic nubs, dry or wet pads or other cleaning materials. The cover is designed to mount to the wheel such that it will rotate in conjunction with the golf cart wheel, enabling a user to hold the golf club against the cleaning area while the cart is moving. In this respect, the user does not have to scrub the golf club head back and forth on the cleaning area, rather the user can idly hold the golf club against the rotating surface as he is walking alongside the moving cart. If desired, while the golf cart is stationary, the user may clean shoes, golf balls or other equipment by rubbing the equipment against the bristles or the moistened or dry cloth pad.

The benefit of this device is readily apparent. The device is always convenient to the golfer while at the course. The device, due to its hollow interior cavity, is lightweight. The golfer does not have to remember to bring the device or pack it in the already bulging golf bag. Because the device is mounted to the wheel of the golf cart, it is rigid enough to be an effective cleaning device when clubs, shoes or golf balls are rubbed against it. The novel rounded shape means that it does not have any projecting edges that would cause injury or damages to others, nor will it catch on anything such that it could be easily pulled off or damaged.

The cover may be appreciated in a variety of shapes, however in the preferred embodiment, the dome shape was found to be beneficial due to the efficient use of space, its ability to fit perfectly on a golf cart wheel and its low chances of causing or receiving damage by virtue of the low profile rounded characteristics. The location is ideal as the cover is always readily available to the golfer. The shape accommodates the entire wheel hub and rim, allowing for a large area to accommodate various types of cleaning surfaces including brushes, nubs and wet or dry pads. A modified funnel shape was also found to be beneficial in that the large open end of the funnel could cover the wheel hub and the small open end of the modified funnel could hold a wet pad, while the sides of the funnel could accommodate brush bristles or other cleaning surfaces. A partial dome shape was also employed in the same respect, with a flat front projecting out from the wheel and accommodating a wet pad while the curved sides supported the outwardly projecting brush bristles.

The disclosure is distinguished from the prior art by several important factors which allow for more effective cleaning and greater convenience.

The novel shapes employed in the described embodiments serve important functions by allowing for maximum cleaning surface while maintaining a low profile, non obtrusive effect on the cart. The functionality of being able to be mounted to the wheel rim and hub provide several convenience factors. First, the device is close to the ground, where one's shoes and golf clubs tend to be, rendering use of the device quick and convenient. Second, the device is always conveniently located near the golfer, as opposed to a handheld brush which may get left at home, in the car, or become lost in the bottom of the golf bag. This is also preferential to a vehicle mounted device which the golfer cannot access while he is actually playing the course. As golfers need to keep their clubs and shoes free of accumulated mud, dirt and grass even while playing, the vehicle mount lacks some practical application. Third, mounting the device to the golf cart wheel offers more effective cleaning due to the contributing rotation aspect, allowing one to walk alongside or ride in the cart while holding the golf club in front of the rotating cleaning surface. Because the invention mounts to the wheel hub, the brush rotates in concert with rotation of the wheel as the golf cart is traveling. This is a great improvement, because, on a three wheeled golf cart, it enables the user to push the golf cart while simultaneously holding a golf club against the dome and letting the rotating motion of the bristles thoroughly clean the club. The user does not have to stop to clean his clubs. The club is more thoroughly cleaned due to the rotating motion.

Fourth, the dome shape of the brush is designed to fit over a standard golf cart wheel and, for that purpose, in a preferred embodiment the device may be approximately 7" in diameter. This provides a much larger surface area for cleaning than the majority of devices in the prior art and also fits perfectly over the wheel. This provides the opportunity to include more than one type of cleaning bristle, nub or surface on the same cover. The cover may be rigid such as plastic, wood or metal or may be of a semi-flexible material such as rubber or softer plastics.

The disclosed invention may be mounted in a permanent, semi-permanent or temporary fashion. In a preferred embodiment, the device may be sold directly to a golfer, with accompanying cable ties, zip ties, wire ties, Velcro, straps, screws, nuts, bolts or other suitable means of mounting. A temporary means of mounting allows a user to take the device to the golf course, quickly mounting and using the device on a three wheeled or motorized golf cart, and removing it upon departure. If the user has their own golf cart they will likely wish to mount the device on the wheel of their cart and leave it there indefinitely, in which case they will no longer have to personally transport the device at all. Companies may wish to factory mount the device to golf carts prior to selling the carts, as a convenient accessory and sales point.

Both the dome and the modified funnel shape provide yet another functional advantage over the prior art. Due to their shape and the hollow interior, the cover fits perfectly over the wheel rim yet has space inside, between it and the wheel, where a solution embodiment can be added. In this alternative embodiment, a portion of the dome is mounted with a sponge or cloth which feeds down into the inside of the dome, whereupon a small reservoir or retaining lip may be located for the purpose of holding water or cleaning solution.

In the case of the small reservoir, as the wheel rotates, the sponge stays moistened via a passage connecting the reservoir to the sponge. In the case of the retaining lip, when the user presses the golf equipment against the sponge, the water is diverted to the inside of the rigid cover. The retaining lip circumscribing the inside edge of the cover catches the water. As the wheel rotates upon movement of the cart, the rotation of the cover causes some of the water to land back on the inside of the sponge, keeping it damp.

The word "pad" when used may refer to any soft means for holding liquid to provide a moist cleaning surface, including but not limited to sponge, pad, cloth, mesh, foam or suitable equivalents.

Figure 1A:
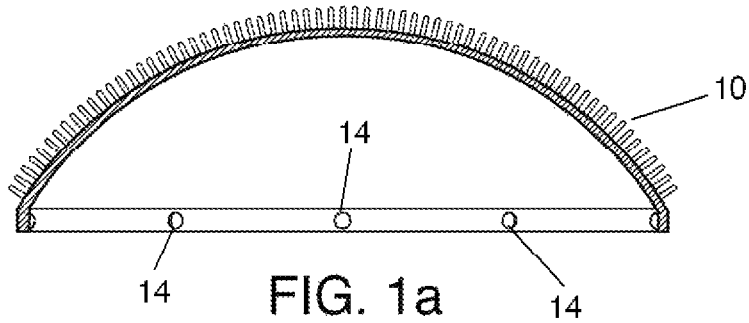
FIG. 1*a* is a side view of the disclosed invention.

Turning to FIG. 1, in a preferred embodiment, the cleaning device 10 is demonstrated as a dome shape with cleaning bristles 12 covering the entire exterior rounded face and a plurality of mounting holes 14 along the perimeter edge of the device. In the preferred embodiment the cleaning bristles are less than two inches in length although a variety of lengths may be contemplated depending upon the specific desired use. FIG. 1*a* exhibits an alternative embodiment of the cleaning device 10 wherein the cleaning bristles only cover a portion of the rounded area, leaving room for a variety of types of cleaning surfaces. The mounting holes 14 are visualized on this figure as well.

Figure 2:
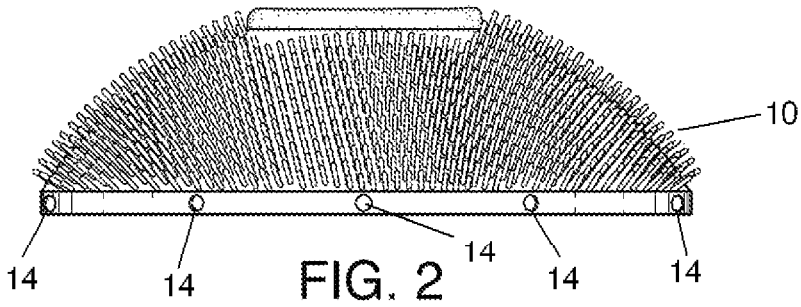
FIG. 2 is a side view of the disclosed invention.

FIG. 2 exhibits an alternative embodiment of the cleaning device 10 in a modified dome shape wherein the cleaning bristles cover only the sides. The top 16 of the modified dome is flat rather than rounded and provides a space for a moistened pad, cloth or other type of cleaning surface, such that the user can clean their equipment more effectively than by using the brush bristles alone.

Figure 3:
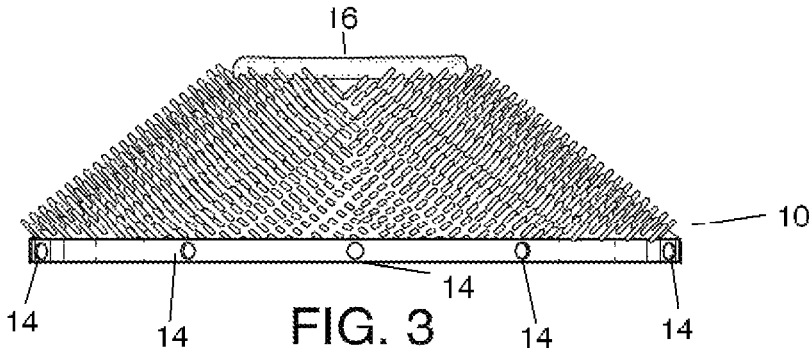
FIG. 3 is a side view of the disclosed invention.

FIG. 3 depicts the preferred embodiment in a funnel shape, allowing for more versatile application of various types of cleaning surfaces.

Figure 4:
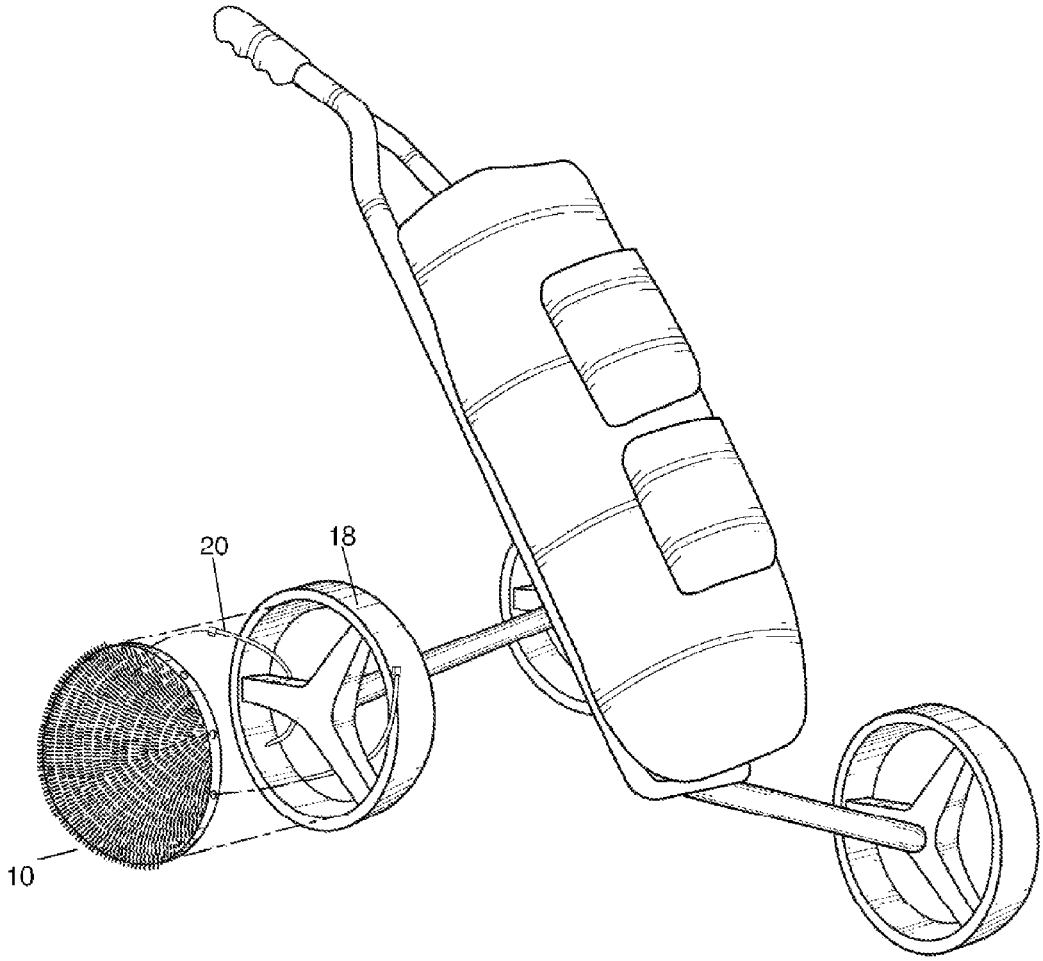
FIG. 4 is a prospective view of the disclosed invention as it is being mounted.

FIG. 4 illustrates the device 10 being mounted in a preferred embodiment to the golf cart wheel 18, using zip or cable ties or other suitable means of mounting. The ties 20 pass through the mounting holes 14 on the device 10 and further pass through the golf cart wheel 18 at which point they are fastened. As golf cart wheel styles will vary, the exact mounting procedure will vary. A variety of mounting mechanisms may be used and the mounting may be temporary, semi-permanent or permanent, as the user desires.

Figure 5:
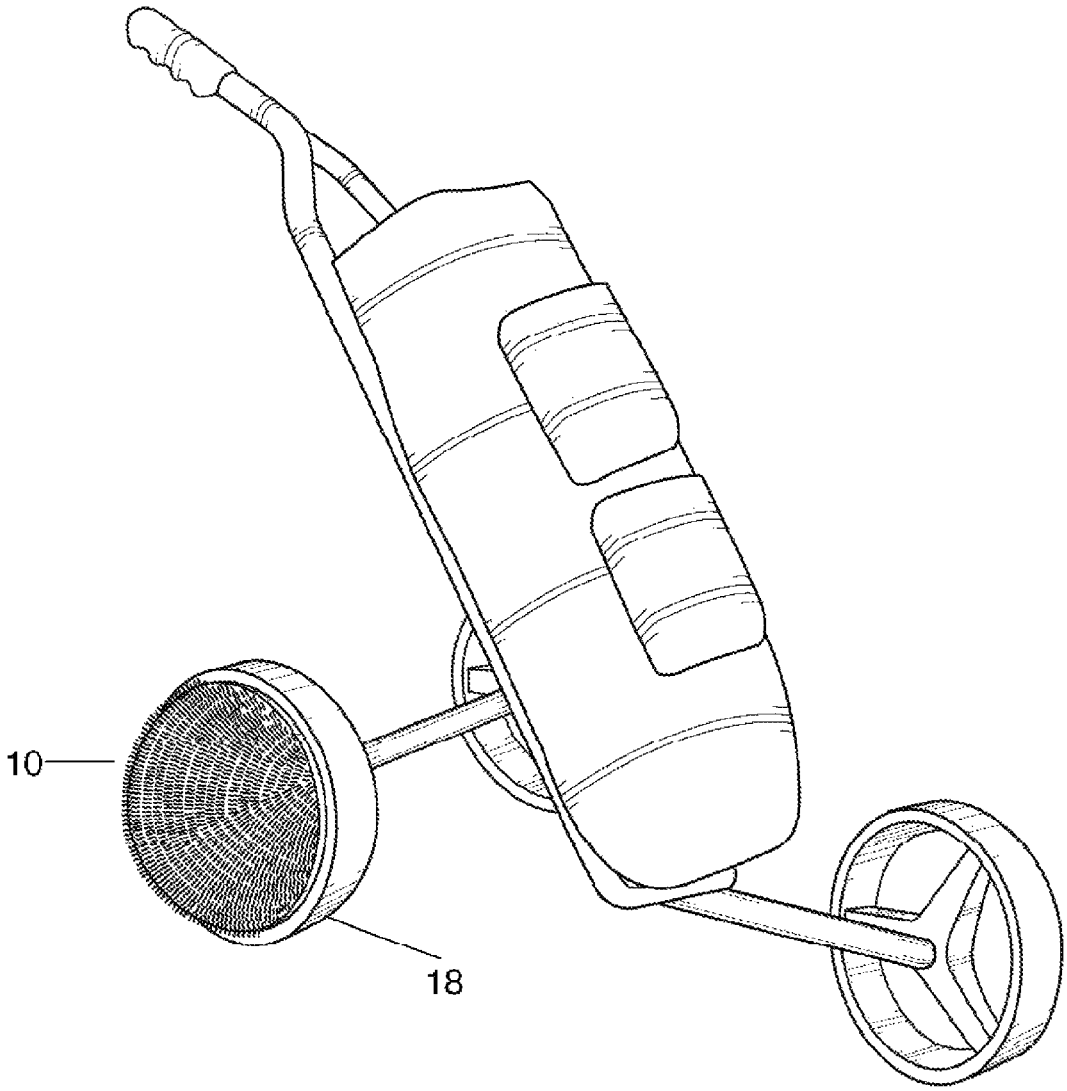
FIG. 5 is a prospective view of the disclosed invention mounted to the wheel of a three wheel hand held golf cart.

Turning to FIG. 5, the device 10 is shown mounted to the outside of the golf cart wheel 18. Although a three wheeled push golf cart is illustrated in the figures, the device can be mounted to a motorized golf cart as well and can be adapted in terms of size and mounting accoutrements to best accommodate the type of golf cart.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

Certain terms are used throughout the description to refer to particular method components. As one skilled in the art will appreciate, design and manufacturing companies may refer to a component by different names. This document does not intend to distinguish between components that differ in name but not function.

The terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other intermediate devices and connections. Moreover, the term "method" means "one or more components" combined together. Thus, a method can comprise an "entire method" or "sub methods" within the method.

The use of the word "a" or "an" when used in conjunction with the word "comprising" may mean "one", or may also mean "one or more." The use of the term "or" in the claims is used to mean "and/or" unless explicitly indicated to refer to alternatives only or the alternatives are mutually exclusive, although the disclosures supports a definition that refers to only alternatives and "and/or."

The methods and systems disclosed and claimed herein can be made and executed without undue experimentation based on the level of disclosure presented. While the methods and systems have been described in terms of their preferred embodiments, it will be apparent to those skilled in the art that they are not limited to the exact steps described and may vary from such description without departing from the scope and spirit of the invention. The substitutes and modifications employed by one skilled in the art are deemed to fall within the scope of the invention.

What is claimed is:

1. A golf equipment cleaning device, the device comprising:

a golf cart wheel cover for mounting to an exterior side of a golf cart wheel such that the cover rotates in conjunction with the movement of the wheel, the cover having a hollow interior and a perimeter edge having along it a plurality of mounting holes;

one or more cleaning surfaces laterally disposed across the cover's exterior, and one or more fasteners passing through the mounting holes and fastening to the golf cart wheel, for mounting the cover to the wheel.

2. The cleaning device of claim 1 wherein the cover is dome shaped.

3. The cleaning device of claim 1 wherein the cover is partially dome shaped, having rounded sides and a flat front.

4. The cleaning device of claim 1 wherein the said one or more fasteners are selected from a group consisting of zip ties, cable ties, Velcro, straps, screws, nuts or bolts.

5. The cleaning device of claim 1 wherein at least one of the said one or more cleaning surfaces consists of brush bristles projecting outwardly from the exterior face of the cover.

6. The cleaning device of claim 1 wherein at least one of the said one or more cleaning surfaces is a moistened pad.

7. The cleaning device of claim 1 wherein at least one of the said one or more cleaning surfaces is thermoplastic nubs.

8. A device for cleaning golf equipment while on the golf course, the device comprising:

a bowl shaped cover having a hollow interior and a plurality of mounting holes along a perimeter edge of said cover;

one or more cleaning surfaces traversing the exterior side of the cover;

one or more fasteners passing through the mounting holes for mounting the cover to the exterior side of a golf cart wheel.

9. The cleaning device of claim 8 wherein at least one of the said one or more fasteners are selected from a group consisting of zip ties, cable ties, Velcro, straps, screws, nuts or bolts.

10. The cleaning device of claim 8 wherein at least one of the said one or more cleaning surfaces is brush bristles projecting outwardly from the cover.

11. The cleaning device of claim 8 wherein at least one of the said one or more cleaning surfaces is a moistened pad.

12. The cleaning device of claim 8 wherein at least one of the said one or more cleaning surfaces is thermoplastic nubs.

* * * * *